United States Patent [19]

McNamara et al.

[11] Patent Number: 4,884,342

[45] Date of Patent: Dec. 5, 1989

[54] UTILITY KNIFE

[75] Inventors: William J. McNamara, Flemington; Stephen Keane, Scotch Plains, both of N.J.

[73] Assignee: William J. McNamara, Scotch Plains, N.J.

[21] Appl. No.: 204,104

[22] Filed: Jun. 8, 1988

[51] Int. Cl.[4] ..... B26B 5/00

[52] U.S. Cl. ..... 30/162; 30/290; 30/294; 30/335; 30/339

[58] Field of Search ..... 30/162, 290, 294, 335, 30/337, 338, 339, 125

[56] References Cited

U.S. PATENT DOCUMENTS

| | | | |
|---|---|---|---|
| 1,108,161 | 8/1914 | Field | 30/292 |
| 1,574,641 | 8/1925 | Christopherson | 30/293 |
| 1,806,484 | 5/1931 | Michaud | 30/293 |
| 1,871,968 | 8/1932 | Ege | 30/293 |
| 2,483,092 | 9/1949 | Hauke | 30/294 |
| 2,537,287 | 1/1951 | Thomas | 30/294 |
| 2,677,180 | 2/1950 | Schierghofer | 30/292 |
| 2,867,901 | 1/1959 | Warnes | 30/162 |
| 2,889,623 | 6/1959 | Baker | 30/294 |
| 2,994,899 | 8/1961 | Moilanen | 15/244.2 |
| 3,500,540 | 3/1970 | Lundquist | 30/294 |
| 3,660,896 | 5/1972 | Umholtz | 30/162 |
| 3,845,554 | 11/1974 | Joanis et al. | 30/339 |
| 4,196,515 | 4/1980 | Sugiyama | 30/162 |
| 4,277,888 | 7/1981 | Szabo | 30/162 |
| 4,292,738 | 10/1981 | Osada | 30/162 |
| 4,586,256 | 5/1986 | Weimann | 30/162 |
| 4,761,882 | 8/1988 | Silverstein | 30/335 |

*Primary Examiner*—Frank T. Yost
*Assistant Examiner*—Rinaldi Rada
*Attorney, Agent, or Firm*—Lerner, David, Littenberg, Krumholz & Mentlik

[57] ABSTRACT

A cutting device including a handle and blade. The blade being detachably connectable to the handle, and the handle including a guidance mechanism. This guidance mechanism has a convex peripheral edge and is rotatively connected to the handle. The cutting device also includes an engagement and disengagement mechanism for operatively interrelating the blade with the guidance mechanism.

15 Claims, 8 Drawing Sheets

UTILITY KNIFE

FIELD OF THE INVENTION

The present invention relates to utility knives. Specifically, utility knives adapted for cutting wallpaper which include a guidance mechanism and include a blade replacement mechanism.

BACKGROUND OF THE INVENTION

Over the years, numerous types of utility knives have been developed. Many with specific applications in mind, such as cutting wallpaper, and many directed to specific problems, such as ease of use and operation.

Wallpaper cutting devices are generally utility knives adapted for neatly cutting wallpaper during application. The overriding characteristic of such a device is a razor sharp blade. Wallpaper cutting devices have also evolved for specific application to particular circumstances. For instance, wallpaper cutting devices have been devised which utilize shaped blades particularly adapted to the type of wallpaper to be cut. Similarly, wallpaper cutting devices have been devised which not only cut the wallpaper, but perform a further task.

In this regard, the art associated with wallpaper cutting devices has seen the introduction of numerous cutting devices adapted specifically for cutting wallpaper along irregular edges. These devices have included, inter alia, rigid guides and wheeled guides for directing the cutting device along an edge dictated by the wall surface itself. These devices though, for various reasons, have failed to provide satisfactory results and have resultingly not been widely accepted.

Generally, the major shortcoming of these previously developed guided devices is their lack of versatility. These devices have generally been superior at solving particular problem. For example a device may be superior at cutting a straight line, and correspondingly, poor at cutting a curved line. Or, in the alternative, a device may be superior at cutting a curved line, and unable to obtain a clean cut along a straight line. Finally, there are devices uniquely adapted for obtaining extremely clean cuts, but whose guides leave something to be desired, whether the line be straight or curved.

The utility knives of the prior art also include devices which are directed to ease of use and operation. Generally, utility knives require disassembly in order for a worn blade to be replaced. This obviously is a significant shortcoming, especially if the user is in a position where such replacement is difficult or impossible. In this regard, the prior art has developed segmentable and detachable blades. Unfortunately, the devices which use a segmentable blade eventually require blade replacement and accordingly, only postpone the problems incident thereto. Similarly, the device with detachable blades utilize attachment mechanisms which are prone to breakage and accidental detachment.

These attachment mechanisms are also normally a feature of a blade adjustment mechanism. This dual function, while at first glance worthwhile, is in fact detrimental. Such a dual function often results in the blade coming free during use or during blade adjustment. Further, such dual function results in a device which is relatively easily disabled, as a result of one part performing too many tasks. In other words, if either function becomes inoperative as a result of breakage or malfunction, the entire device generally becomes disabled.

SUMMARY AND OBJECTS OF THE PRESENT INVENTION

In accordance with one aspect of the present invention, an improved cutting device is provided which includes a handle with a blade attached to it. Rotatively connected to the handle is a guidance mechanism having a convex peripheral edge which defines the plane in which the blade is operative.

In accordance with another aspect of the present invention a cutting device is provided which includes a handle which is again attached to a blade. In this embodiment, a guidance mechanism is provided which includes members having convex peripheral edges in spaced relation. These convex edges are rotatively connected to the handle and define a medially spaced opening which bisects the convex edges. The blade is at least partially projectable into this medially spaced opening.

In accordance with another aspect of the present invention a cutting device is provided which includes a handle having spaced sidewalls. These spaced sidewalls define an internal channel and at least one opening communicating with that internal channel. The blade is detachably connectable to the handle means in this embodiment, and is disposed at least partially within the internal channel. This embodiment also includes a mechanism disposed on the handle for engaging the blade to the handle and disengaging the blade from the handle. This engaging and disengaging mechanism includes a biasing mechanism which maintains the blade in an engaged position and an actuation member which moves the blade from an engaged position to a disengaged position.

In accordance with yet another aspect of the present invention, a cutting device is provided which includes, a handle having spaced sidewalls which define an internal channel and at least one opening communicating with that internal channel. A blade is included which is detachably connectable to the handle and which is disposed at least partially within the internal channel. A guidance mechanism is also provided which has a convex peripheral edge and is rotatively connected to the handle. There is also included a mechanism for engaging and disengaging the blade from the handle and accordingly, operatively interrelating the blade with the guidance mechanism. This mechanism includes a biasing mechanism, which maintains the blade in an engaged position and an actuation member which moves the blade from an engaged position to a disengaged position.

Accordingly, the present invention provides an improved utility knife, one object of which is the provision of a guidance mechanism capable of obtaining clean cuts under various application parameters.

Another object of the present invention is to provide a utility knife capable of easily adhering to a line as defined by a non-planar surface.

Another object of the present invention is to provide a utility knife capable of obtaining a clean cut on surfaces which include planar irregularities.

Another object of the present invention is to provide a utility knife which performs an enhanced cutting function and a further application function.

Another object of the present invention is to provide an improved blade engagement and disengagement mechanism.

These and other objects of the present invention will become apparent with reference to the description and claims which follow hereinafter when taken in conjunction with the drawings as follows:

DETAILED DESCRIPTION OF PREFERRED EMBODIMENTS OF THE INVENTION

DESCRIPTION OF A FIRST EMBODIMENT

Figure 1:
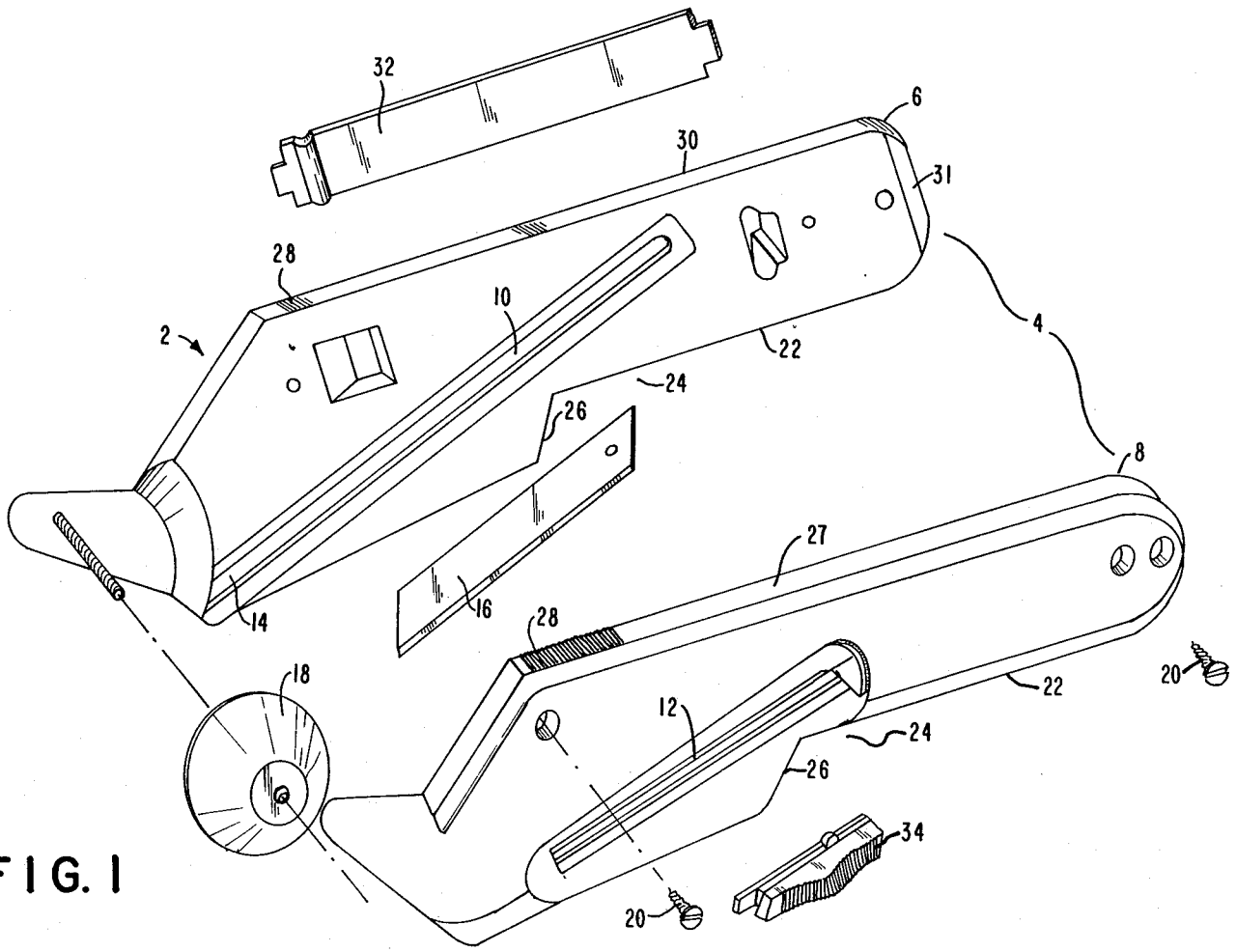
FIG. 1 is a perspective exploded view of the first embodiment of the present invention.
Figure 2:
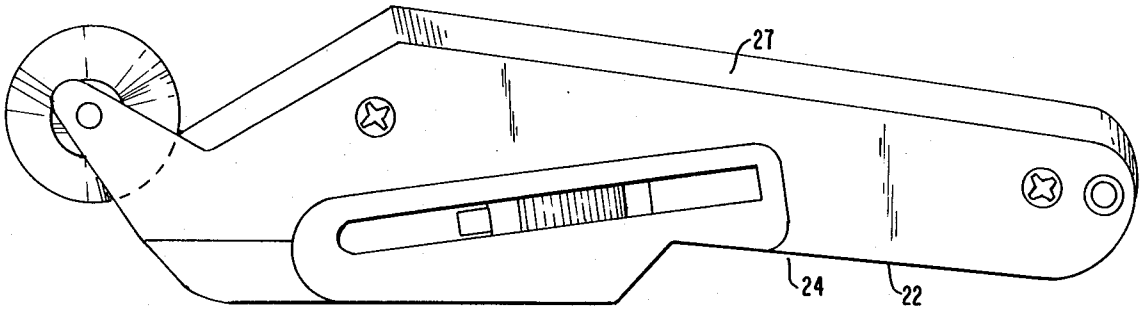
FIG. 2 is a side view of the first embodiment of the present invention.
Figure 3:
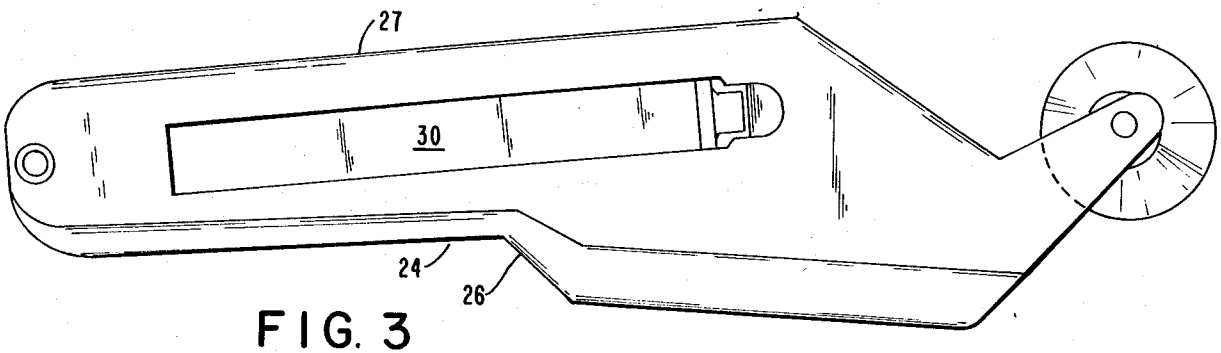
FIG. 3 is an opposite side view of the first embodiment of the present invention.
Figure 4:
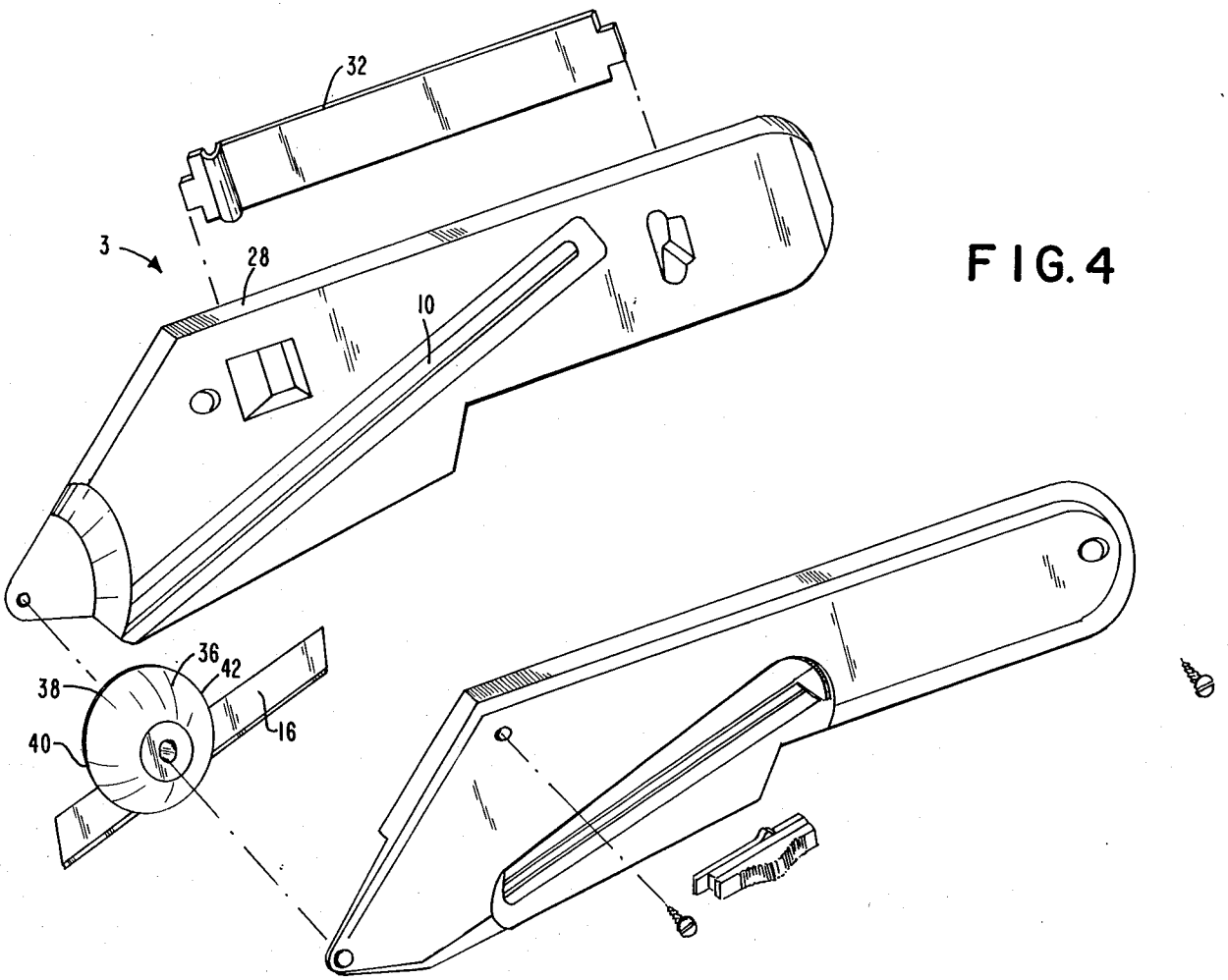
FIG. 4 is a perspective exploded view of the second embodiment of the present invention.

Referring now to the drawings, wherein like reference characters represent like elements, there are shown preferred embodiments of a cutting device 2 in e with the present invention. FIGS. 1 through 3 depict a first embodiment of the present invention including, a handle generally designated 4. Handle 4 includes, spaced sidewall portions 6 and 8 which may be made of any plastic or metal material. These sidewall portions define an internal channel 10. The sidewalls 6 and 8 include openings 12 and 14. Also shown is a blade 16. A guidance mechanism 18, with convex peripheral edges is shown rotatively connectable to the handle.

In assembled position, the blade 16 is at least partially disposed within the internal channel 10 and coacts with th guidance mechanism 18 through the interconnection of handle 4. Specifically, the blade 16 is disposed in predetermined spaced relation to the guidance mechanism 18.

Guidance mechanism 18 is made of a resilient polyurethane material, with moderately stiff resiliency characteristics. Such stiff resiliency allows for the guidance mechanism to perform its guidance function definitely, yet at the same time allows for that mechanism to function as a shock absorber and thereby provide a margin of error. Such resiliency also enhances the inherent cutting function of the cutting device so constructed, as the material to be cut will be held firmly in place Further, such resiliency performs the further application function of pressing that material into place after it has been cut. Such resiliency is particularly desirable when cutting curved lines, as the margin for error incident to such an application is generally low. Here, the resilient wheel prevents the instant cutting device from taking unwanted hops when irregularities, such as paint deposits, are encountered.

Also shown in FIG. 1 are threaded attachment member 20. Although shown here as screws, any conventional attachment member is acceptable. Such attachment means should be removable though, so that sidewalls 6 and 8 may be separated from each other for blade replacement, or repair of the inner workings of the cutting device 2, in case of breakage or malfunction.

Also disclosed in FIG. 1 is the general shape of handle 4 which includes a bottom end 22, which is best seen in FIGS. 2 and 3. Bottom end 22 includes a safety recess 24 in order for cutting device 2 to be safely grasped by a user. As may be seen, recess 24 includes a forward wall 26 which will prevent the users hand from sliding forward and into contact with the blade 16.

Returning now to FIG. 1, also disclosed is a top end 27. Disposed on top end 27 are knurled ridges 28. These knurled ridges are so placed as to allow a user to securely rest his or her thumb on the top of cutting device 2. This provides for a secure and safe grasp and further allows for greater control and accuracy while cutting.

A blade storage compartment is provided and is generally disclosed as element 30. Blade storage compartment 30 includes a blade storage compartment cover designated 32. Blade storage cover 32 is easily removable by a user without the use of any tool, yet at the same time, adapted for a secure fit to one of the sidewalls 6 or 8 of the handle 4. This secure fit prevents accidental spills of the blades held within the storage compartment 30.

Also depicted is a blade alteration mechanism 31 which functions in conjunction with segmentable blades as are known in the art. These blades allow for small sections to be broken off at the tip, thus exposing an unused and sharp edge for cutting purposes. This blade alteration mechanism is particularly useful when the cutting device is being used in an awkward position where blade replacement is either impossible or difficult.

Finally, a blade adjustment mechanism 34 is also depicted. This mechanism allows for the blade 16 to be fixed in various settings of exposure, or in the alternative, completely retracted within internal channel 10.

The present invention as thus embodied, is uniquely adapted for efficient and easy use. A unique guidance mechanism is provided which performs various functions. This guidance mechanism performs an inherent guidance function, a cutting function and an application function. As a guide, this mechanism is uniquely adapted to aid when cutting along and around irregularly shaped surfaces, such as at the corner of a wall or along wall moldings. This guidance function is further enhanced when this mechanism is resilient. Such resiliency acts as a shock absorber and increases the margin of error accordingly. This is achieved by dampening the effects of lumps, dips and other irregularities on the cutting surface.

This mechanism further enhances the inherent cutting function of the cutting device. By utilizing a rotatively guidance mechanism, forces are created and applied perpendicular to the surface to be cut. These forces secure the material to be cut relative to the cutting edge of the blade and thereby help to prevent slippage and false cutting.

This mechanism further performs an application function. These same perpendicular forces which aid in cutting, may also be used to apply the material cut. This function can be performed in conjunction with cutting or as a separate function, simply by turning the device over. Again, because the forces are perpendicular to the surface and rotational, unwanted vertical or side-to-side forces are prevented.

The use of a resilient guidance mechanism enhances both the cutting and application functions of this mechanism as a result of the dampened pressures applied. These dampened pressures enhance cutting by preventing slippage and exerting more uniform and dispersed pressure than a rigid guidance mechanism. These dampened pressures also enhance application by constantly urging the material in a desired direction. This constant urging, contrary to the highly volatile forces which would be created by a solid member, prevent unwanted pressure peaks and resultant tears and irregularities.

Further, this guidance mechanism is uniquely adapted for use with wallpaper. In this regard, it may be seen that the present invention's guidance, cutting and application functions are uniquely suited to such an application. The guidance function of the present invention is uniquely suited for application in the wallpaper environment because of the non-planar edges encountered at the top, bottom and side of walls. Cutting wallpaper with the present invention is easy because of inherent engineering characteristics which enhance efficiency and ease of operation. This wallpaper cutting function is further enhanced by a resilient guidance mechanism. Such a resilient guidance mechanism is uniquely adapted for compressing wallpaper into non-planar areas on a wall. This may best be envisioned if the application of wallpaper next to molding is imagined. In such a case, it is difficult to ensure that the wallpaper is securely fastened in the recess where the wall meets the molding. The present device, by utilizing a resilient convex guidance mechanism which is rotatively mounted, allows for perpendicular pressure to be applied into such crevices. Further, a rotatable guidance mechanism is uniquely adapted to the wallpaper environment because vertical and side-to-side pressures, which have the tendency of pulling and bunching wallpaper, are prevented. The present invention achieves this because rotation prevents such pressures from developing. In conclusion, such resiliency allows the convex guidance wheel to be pressed into areas on a wall otherwise inaccessible, allows for dampened pressures to be applied and prevents irregularities from impacting upon the performance of the device.

DESCRIPTION OF A SECOND EMBODIMENT OF THE INVENTION

FIGS. 4 through 7 disclose a second embodiment 3 of the present invention. This embodiment is generally identical to the first embodiment, but for the construction of the guidance mechanism 40. In this embodiment, the guidance mechanism includes two convex members 36 and 38 in spaced relation which define a medially disposed opening 42. This medially disposed opening bisects the two convex members. In this embodiment, the blade is capable of bisecting the two convex members and is accordingly, operatively interrelated with the guidance mechanism. Such a placement greatly enhances the cutting function, the guidance function and the application function of the instant invention.

Figure 5:
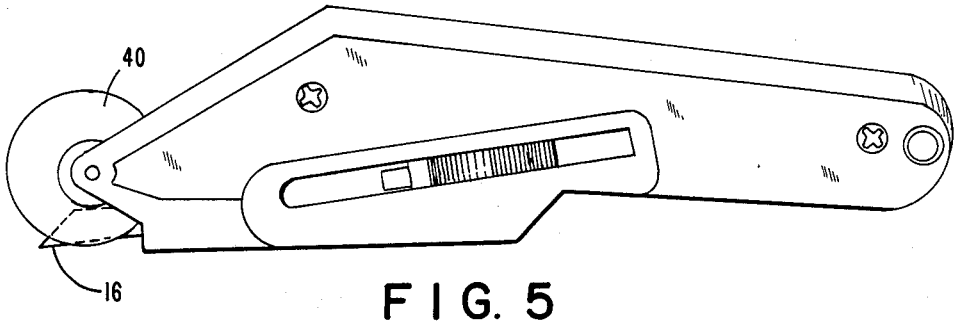
FIG. 5 is a side view of the second embodiment of the present invention.
Figure 6:
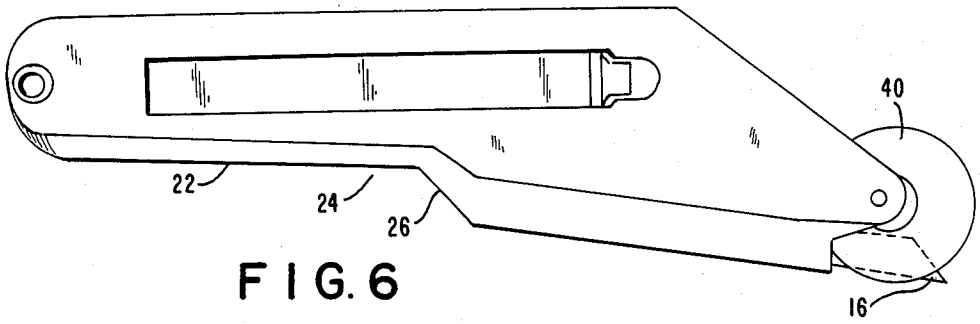
FIG. 6 is an opposite side view of the second embodiment of the present invention.
Figure 7:
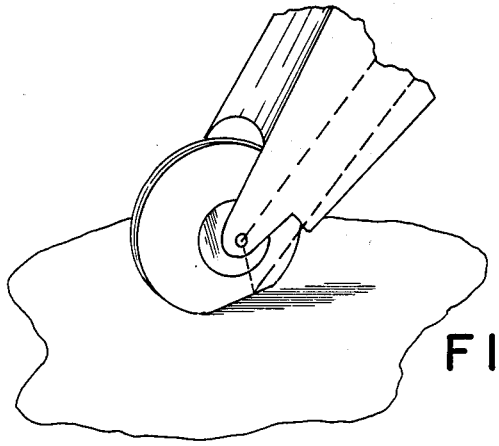
FIG. 7 depicts the guidance mechanism of the second embodiment of the present invention in use.

In this regard, if the blade means is fixed so that its tip meets, but does not protrude from the resilient guidance mechanism's external peripheral edge (as depicted in FIG. 7), the guidance mechanism will then perform both the cutting function and the application function superiorly. Such a placement will first result in the guidance mechanism keeping the blade shielded during non-use; will second, both hold firm and apply the material immediately before the cutting tip; and third, will firmly apply that material immediately after it has been cut. In this way, a particularly clean cut and well applied material is achieved. FIGS. 5 and 6 disclose the opposing side views of this embodiment. It will be seen that the blade 16 is disposed only partially at its tip through the medially exposed opening 42.

Figure 11:
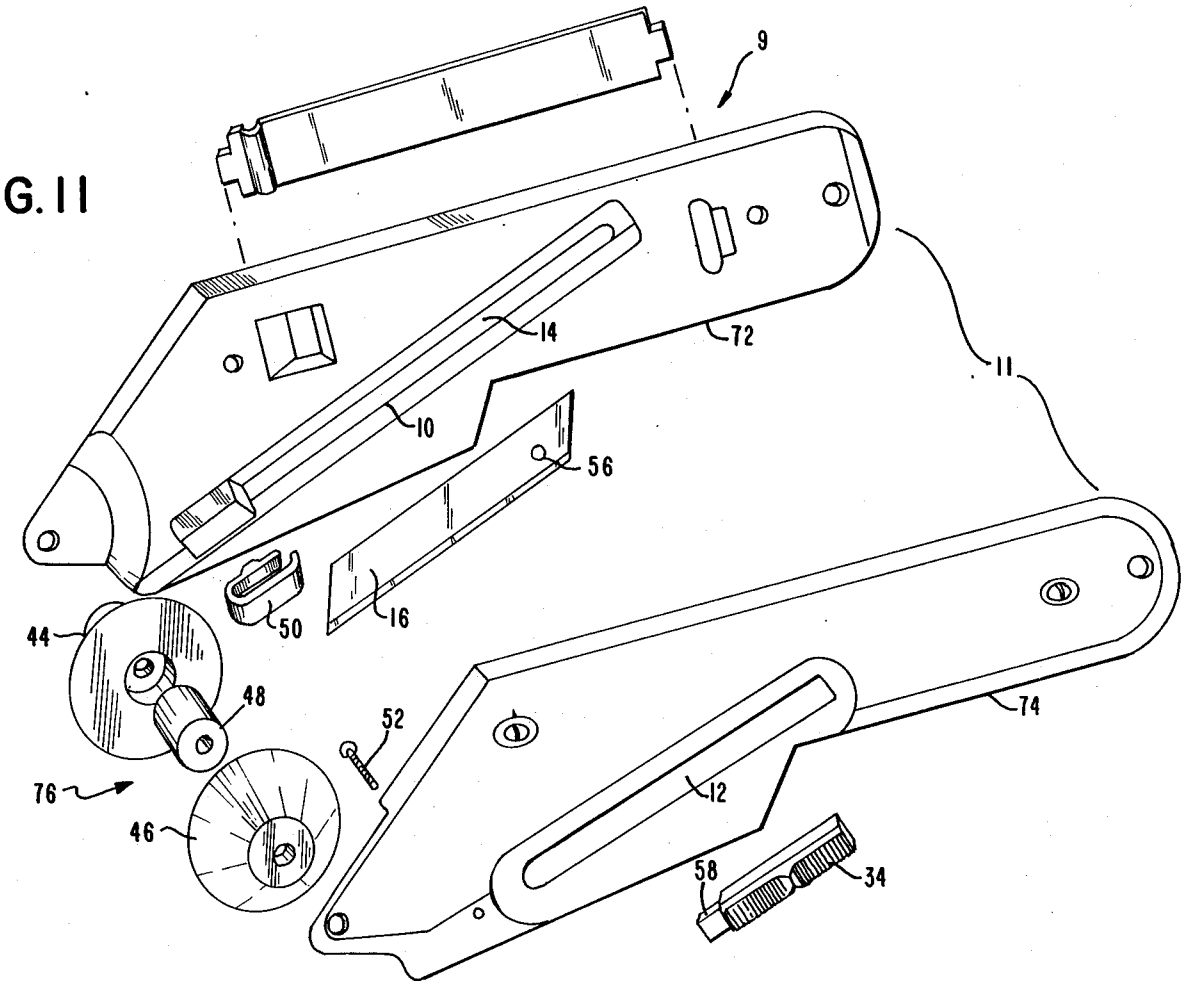
FIG. 11 is a perspective exploded view of the fourth embodiment of the present invention.

Reference is also made at this time to FIG. 11, wherein the guidance mechanism is made up of a first conical wheel means 44 which is shown to be operatively interrelated with a second conical means 46. In this figure, a spacer 48 is also shown. The fourth embodiment as depicted in FIG. 11 performs similar to the second embodiment as herein disclosed in this respect.

DESCRIPTION OF A THIRD EMBODIMENT

Figure 8:
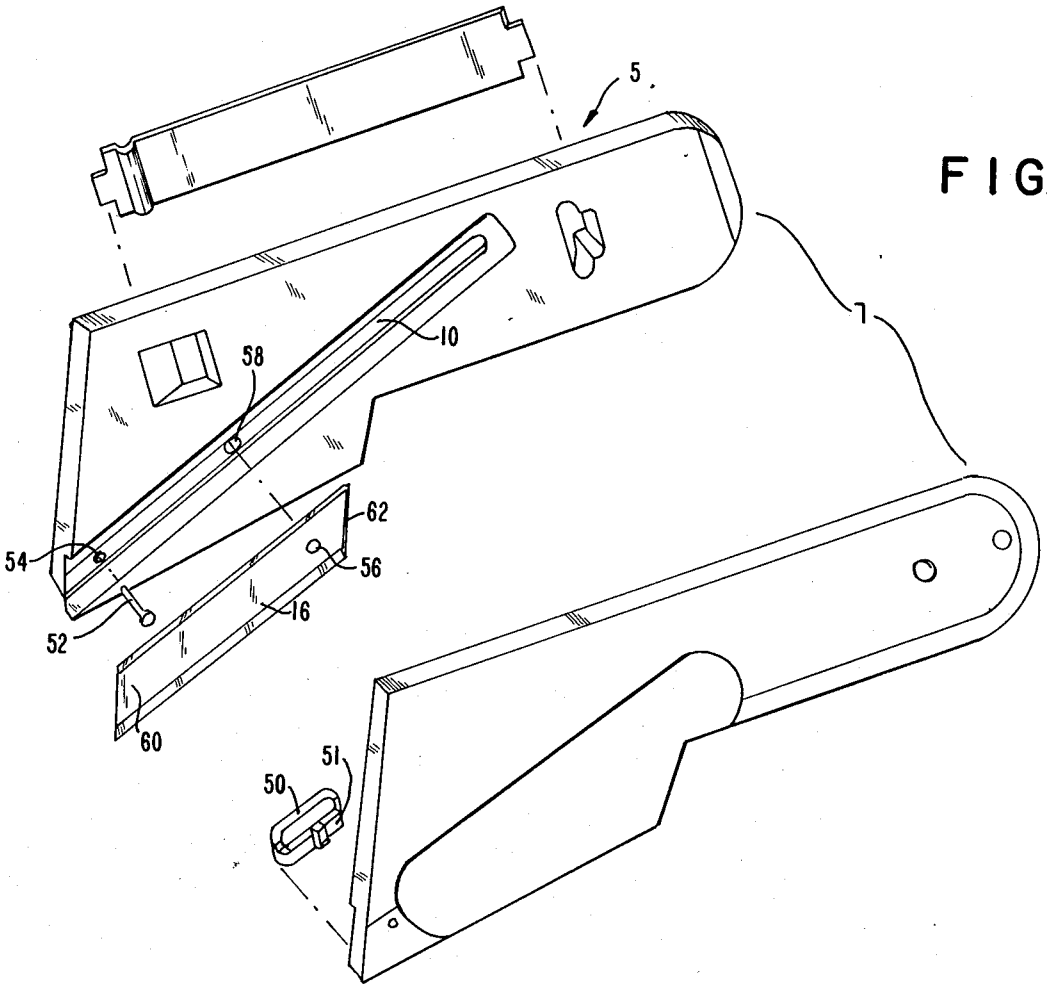
FIG. 8 is a top perspective exploded view of the third embodiment of the present invention.
Figure 9:
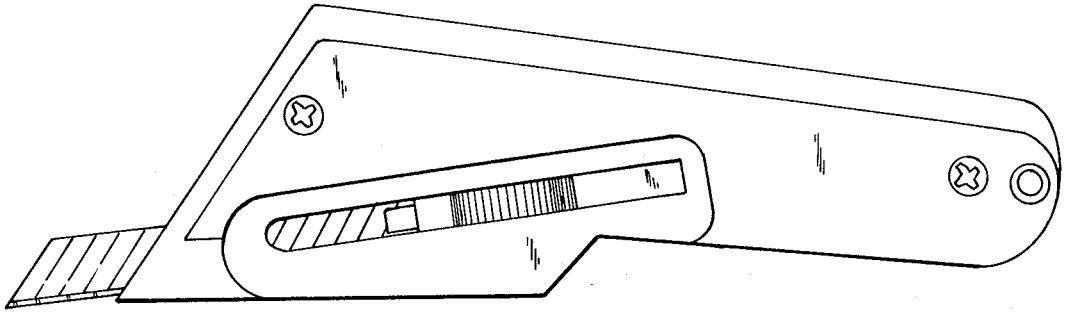
FIG. 9 is a side view of the third embodiment of the present invention.
Figure 10:
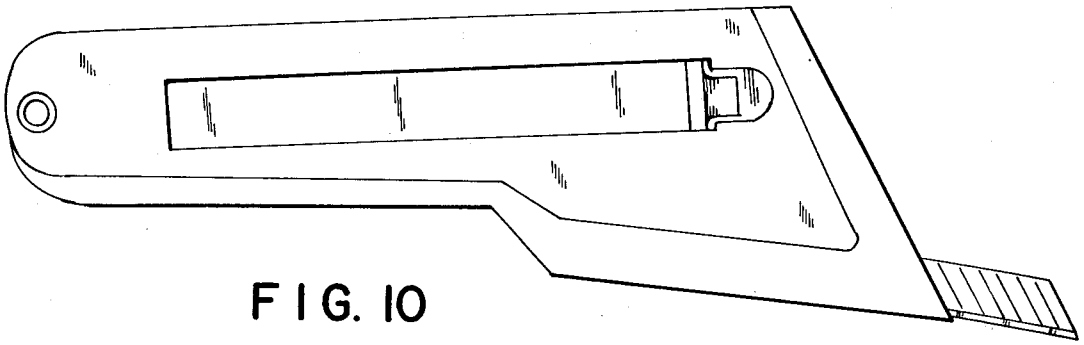
FIG. 10 is an opposite side view of the third embodiment of the present invention.

FIGS. 8 through 10 depict yet another embodiment of the present invention, herein designated as the third embodiment. This third embodiment of the present invention, generally designated 5, depicts a blade engagement and disengagement mechanism shown as a biasing mechanism 50, an actuation member 52, an opening on the handle 54, an opening in the blade 56 (or a second connection member) and a protuberance on the handle 58 (or a first connection member). In an alternative design of this embodiment, protuberance 58 is disposed on the blade adjustment mechanism 34, as shows again viewed in FIG. 11. Protuberance 58, whether disposed on the handle or on the blade adjustment mechanism functions in the same way. Specifically, biasing mechanism 50 maintains blade 16 and specifically opening 56, in engagement with protuberance 58 and resultingly, handle 7. This biasing action is achieved through the use of a pressure member 51. The blade may be disengaged through the use of actuation member 52, which is capable of compressing pressure member 51 and accordingly biasing mechanism 50. The compression of biasing mechanism 50 moves the blade 16 and, specifically the opening 56, out of engagement with the protuberance 58. When disengaged, the blade 16 is then easily removed from the cutting device 2 simply by grasping its exposed tip 60 and sliding it outward from the internal channel 10. For replacement, a new blade is simply inserted within the internal channel 10 and moved until opening 56 engages protuberance 58.

Further, for replacement purposes, the blade may be provided with a rounded edge 62 in order to prevent protuberance 58 from stopping the motion of blade 16 in the direction of protuberance 58. In the alternative, protuberance 58 may be provided with a rounded edge, the latter being less preferred. Rounded edge 62 will allow blade 16 to easily compress biasing means 51 a sufficient amount to allow blade 16 and specifically edge 62 to travel up and over protuberance 58 until opening 56 is aligned with protuberance 58 and accordingly is in fixed engagement therewith.

This embodiment introduces a unique engagement and disengagement mechanism. Wherein the blade 16 itself moves out of engagement, rather than any connection mechanism moving. Further, when such connection mechanism moves at all, as when it is attached to the blade adjustment mechanism as in FIG. 11, such movement has no effect on the engagement or disengagement of the blade, as blade adjustment is perpendicular to the forces necessary for disengagement. Accordingly, the chances of accidental disengagement are reduced. Further, by having elements uniquely designed for their particular function, rather than elements combined into one mechanism, those independent elements may be better engineered and not dependent upon the design requirements of any other element. Accordingly, the biasing mechanism utilized in the instant invention is much less likely to break than a biasing mechanism which is connected to a continually moving blade adjustment mechanism. Similarly, a blade adjustment mechanism which only performs that function, is much less likely to break when it has been specifically engineered to perform that function.

DESCRIPTION OF A FOURTH EMBODIMENT

Figure 12:
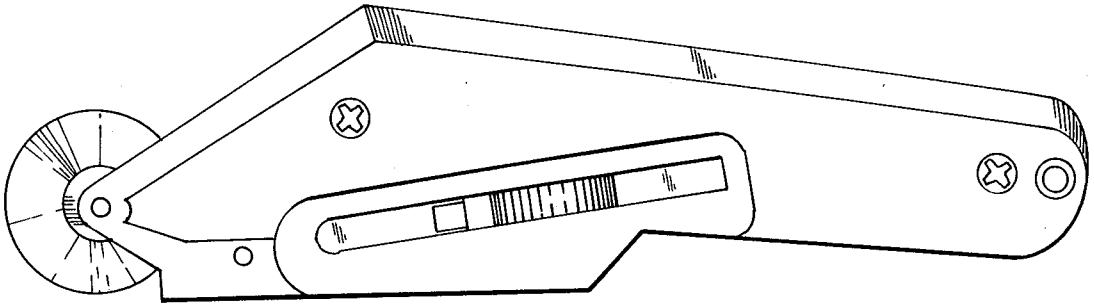
FIG. 12 is a side view of the fourth embodiment of the present invention.
Figure 13:
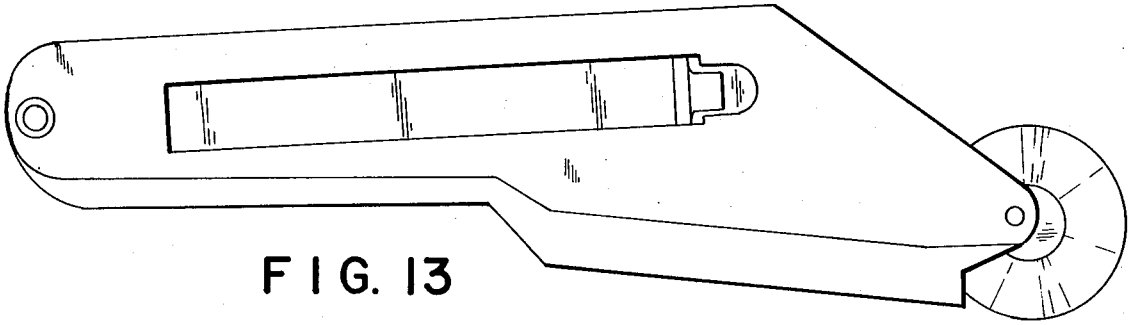
FIG. 13 is an opposite side view of the fourth embodiment of the present invention.

The fourth embodiment of the present invention, is a combination of the lions share of elements discussed above and is depicted in FIGS. 11 through 13. This embodiment demonstrates but one possible combination of the preceding elements. This particular embodiment demonstrates what is perceived as a preferred combination, and as such, an extremely useful and easy to use cutting device specifically adapted for a wallpaper cutting application.

FIG. 11 depicts a cutting device 9 which includes a handle 11. Handle 11 includes, spaced sidewalls 72 and 74. Spaced sidewalls 72 and 74 define an internal channel 10 and openings 12 and 14 communicating with internal channel 10. Blade 16 is seen disposed within internal channel 10.

Cutting device 9 also includes a guidance mechanism 76. Guidance mechanism 76 includes a resilient conical wheel 44, a second conical wheel 46 and a spacer 48. Also included is the unique blade replacement mechanism, shown as biasing mechanism 50, actuation member 52, an opening in the blade 56 and a protuberance 58. As can be seen, protuberance 58 is disposed on a blade adjustment mechanism 34. Blade adjustment mechanism 34 is disposed within internal channel 10 and accessible from one of the open defined by the spaced sidewall portions. This is but one combination of the many unique and useful elements presented by the instant invention.

Accordingly, the instant invention introduces an extremely accurate and versatile guidance mechanism. This guidance mechanism is adapted for guiding a utility device along various cutting applications; i.e. along non-planar surfaces, along planar surfaces with planar irregularities, along straight lines and along curved lines, etc. Further, this guidance mechanism performs additional cutting functions and application functions by introducing forces perpendicular to the cutting surface.

The instant invention also introduces a unique blade engagement and disengagement mechanism which greatly increases ease of use and productivity. This mechanism, by being independent of any other mechanism allows a utility knife employing it to continue to perform its allotted task whether one function becomes disabled or not. Specifically, as is provided in one embodiment, if the blade adjustment mechanism malfunctions, the utility knife employing this mechanism continues to be functional because blade replacement is not hindered. Further, as the blade replacement mechanism is disposed independent of the blade adjustment mechanism, and a unique, but well known segmentable blade utilized, even when the blade replacement mechanism malfunctions, the present invention may continue to perform its allotted task.

Although the invention herein has been described with reference to a specific embodiments, it is to be understood that these embodiments are merely illustrative of the principles and applications of the present invention. More specifically, it is to be understood that the embodiments, as represented in the detailed description of preferred embodiments of the invention, are those embodiments which the inventor presently believes to be preferred. It is to be understood that numerous modifications may be made to these illustrative embodiments and that other arrangements may be devised from the spirit and scope of the present invention as defined by the appended claims.

We claim:

1. A retractable, guided utility knife comprising:

a. an elongated handle having a front end, back end, top edge and bottom edge, comprising a first half-handle sidewall secured to a second half-handle sidewall, at least one of said sidewalls having a lengthwise internal passageway and at least one of said sidewalls having a lengthwise external opening, said opening at least partially coextensive with said passageway;

b. an elongated retractable blade slidably mounted between said sidewalls and extendable from said front end;

c. a protruding member slidably mounted within said passageway and removably fixed to said blade;

d. biasing means positioned against said blade for holding said blade against said protruding member;

e. releasing means for moving said blade laterally against said biasing means, away from said protruding member, to release said blade from said protruding member;

f. adjustment means slidably mounted within said opening, removably fixed to said blade, for moving said blade along said passageway; and g. roller means positioned at said front end, between said sidewalls, for guiding said blade along a cutting path.

2. A utility knife as in claim 1, wherein said blade is segmentable.

3. A utility knife as in claim 2, further comprising a wedged recess on the outer surface of said handle for breaking off a segment of said blade.

4. A utility knife as in claim 3, wherein said wedged recess is located on said back end.

5. A utility knife as in claim 1, further comprising a blade storage compartment for the storage of spare blades.

6. A utility knife as in claim 5, wherein said blade storage compartment is located on the side of one of said sidewalls and comprises a detachable cover.

7. A utility knife as in claim 1, wherein said blade has a hole along its side, said protruding member is removably inserted into said hole and said releasing means moves said blade such that said protruding member is removed from said hole.

8. A utility knife as in claim 1, wherein said handle comprises knurled ridges along said top edge.

9. A utility knife as in claim 1, where in a portion of said bottom edge, beginning at said back end and extending toward said front end, comprises a notched recess to facilitate gripping said handle.

10. A utility knife as in claim 1, wherein said roller means comprises a convex peripheral edge.

11. A utility knife as in claim 1, wherein said roller means are comprised of a resilient polyurethane material.

12. A utility knife as in claim 1, wherein the lengthwise axis of said elongated blade intersects said top and bottom edges at an acute angle.

13. A utility knife as in claim 1, wherein said roller means comprises two rollers, both rotatable about the same axis, and said elongated blade is extendable between said rollers.

14. A utility knife as in claim 13, wherein each of said rollers is in the shape of a frustrum.

15. A utility knife as in claim 1, wherein said protruding member is affixed to said adjustment means.

* * * * *